US006787026B2

(12) United States Patent
Farshid

(10) Patent No.: US 6,787,026 B2
(45) Date of Patent: Sep. 7, 2004

(54) PROCESS FOR THE PRODUCTION OF HIGH QUALITY BASE OILS

(75) Inventor: Darush Farshid, Larkspur, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 109 days.

(21) Appl. No.: 10/282,767

(22) Filed: Oct. 28, 2002

(65) Prior Publication Data

US 2004/0079677 A1 Apr. 29, 2004

(51) Int. Cl.[7] ..... C10G 45/00

(52) U.S. Cl. ..... 208/89; 208/58; 208/59; 208/83; 208/97; 208/100; 208/105; 208/210; 208/212; 208/252

(58) Field of Search ..... 208/58, 89, 97, 208/83, 105, 100, 59, 210, 212, 252

(56) References Cited

U.S. PATENT DOCUMENTS

| | | | | |
|---|---|---|---|---|
| 5,580,442 | A | 12/1996 | Kwon et al. | 208/89 |
| 5,976,354 | A | 11/1999 | Powers et al. | 208/89 |
| 6,099,719 | A | 8/2000 | Cody et al. | 208/87 |
| 6,136,181 | A | 10/2000 | Ziemer | 208/144 |
| 6,702,935 | B2 * | 3/2004 | Cash et al. | 208/58 |
| 2003/0111386 | A1 * | 6/2003 | Mukherjee et al. | 208/58 |
| 2003/0111387 | A1 * | 6/2003 | Mukherjee et al. | 208/89 |

* cited by examiner

*Primary Examiner*—Walter D. Griffin
*Assistant Examiner*—James Arnold, Jr.
(74) *Attorney, Agent, or Firm*—Penny L. Prater

(57) ABSTRACT

This invention is directed to a process for hydroprocessing vacuum gas oils and other feeds in order to produce unconverted oil suitable for use as base oil feed for white oils, Group III oils, and BMCI (Bureau of Mines Correlation Index) ethylene plant feed. Ammonia, hydrogen sulfide, and light products are removed from the first stage at high pressure in order to produce a higher quality of unconverted oil that is suitable for Group III base oils.

10 Claims, 1 Drawing Sheet

PROCESS FOR THE PRODUCTION OF HIGH QUALITY BASE OILS

FIELD OF THE INVENTION

This invention is directed to a multi-stage process for hydroprocessing vacuum gas oils and other feeds. In addition to gases and middle distillates, this process can produce unconverted oil which is suitable for use as base oil feed for white oils, Group III oils, and low BMCI (Bureau of Mines Correlation Index) ethylene plant feed.

BACKGROUND OF THE INVENTION

Suitable base stocks for Group III oils have traditionally been produced in a variety of ways. U.S. Pat. No. 6,136,181 (Ziemer) discloses a process for hydrofinishing and hydrocracking feeds containing sulfur and nitrogen to produce base stocks suitable for use in preparation of Group III oils and white oils. A catalyst comprising a platinum-palladium alloy is employed.

U.S. Pat. No. 6,099,719 (Cody et al.) discloses a process for the preparation of lube oil basestocks suitable for Group III oils. A lube oil feedstock is subjected to solvent extraction and solvent dewaxing prior to a two-step hydroconversion process, which is followed by hydrofinishing and dewaxing steps.

U.S. Pat. No. 5,580,442 (Kwon et al.) employs recycle of unconverted oil to produce high quality lube base oil. VGO is produced by vacuum distillation, then hydrotreated. The hydrotreated VGO is then hydrocracked and light hydrocarbons, along with light oil products, are removed. A portion of the unconverted oil is fed to a second vacuum distillation unit. Material not converted to products in the vacuum distillation unit is recycled to the hydrocracker.

Another approach to obtaining Group III basestocks involves two-stage hydroprocessing, in which the effluent from a first stage operated at low pressure is mixed with second stage effluent. The resultant mixture is sent to the fractionation section for product recovery at low pressure. Often a bleed stream from the unconverted oil is taken for feed to the downstream units (such as Group III base oil production or ethylene cracking). The quality of this unconverted oil is not sufficiently high, without further processing to be used as Group III base oil feed or low Bureau of Mines Correlation Index ethylene plant feed.

SUMMARY OF THE INVENTION

In the configuration of this invention, the feed to the second stage is a mixture of first and second stage unconverted oil. The first stage is operated at high pressure and the second stage is operated at a lower pressure. The feed to the second stage is high quality unconverted oil, and may be used as feed for Group III base oil production, ethylene plant feed, white oil production, etc.

The invention is summarized below:

1. A method for hydroprocessing a hydrocarbon feedstock which produces a stream of unconverted oil of sufficient quality for use as a base oil feed for the production of Group III oils, white oils, and low BMCI ethylene plant feed, said method employing multiple reaction zones within a single reaction loop, comprising the following steps:

(a) passing a hydrocarbonaceous feedstock to a first hydroprocessing zone, the hydroprocessing zone having one or more beds containing hydroprocessing catalyst, the hydroprocessing zone being maintained at hydroprocessing conditions, including a pressure in the range from 1200 to 2500 psig, wherein the feedstock is contacted with catalyst and hydrogen;

(b) passing the effluent of step (a) directly to a hot high pressure stripper, wherein the effluent is contacted with a hydrogen-rich stripping gas to produce a vapor stream comprising hydrogen, hydrocarbonaceous compounds boiling at a temperature below the boiling range of the hydrocarbonaceous feedstock, hydrogen sulfide, ammonia, and a bottoms stream comprising hydrocarbonaceous compounds boiling in approximately the same range of said hydrocarbonaceous feedstock along with a portion of the hydrocarbonaceous compounds boiling in the diesel boiling range;

(c) passing the overhead vapor stream from the hydrogen stripper of step (b) to a first cold high pressure separator where hydrogen, hydrogen sulfide and light hydrocarbonaceous gases are removed overhead and a liquid stream comprising naphtha, middle distillates and unconverted oil is passed to fractionation, thereby removing most of the ammonia and some of the hydrogen sulfide (as ammonium bi-sulfide in the sour water stream as it leaves the cold high-pressure separator);

(d) combining the liquid stream from the hydrogen stripper of step (b) with a portion of the unconverted oil of the fractionation step of step (c) and passing the combined stream to a bed of hydroprocessing catalyst in a second reactor zone, wherein the liquid is contacted under hydroprocessing conditions with the catalyst, in the presence of hydrogen, and under a pressure in the range from 1500 to 2500 psig;

(e) passing the overhead from the cold high pressure separator of step (d) to an amine absorber, where hydrogen sulfide is removed before hydrogen is compressed and recycled to hydroprocessing vessels within the loop;

(f) passing the effluent of step (d), after cooling, to a second cold high pressure separator where hydrogen, hydrogen sulfide and light hydrocarbonaceous gases are removed overhead and a liquid stream comprising naphtha, middle distillates and unconverted oil is passed to fractionation, thereby removing most of the ammonia and some of the hydrogen sulfide (as ammonium bi-sulfide in the sour water stream as it leaves the second cold high-pressure separator);

(g) passing the vapor stream from step (f) after further cooling and separation of condensate, to the recycle gas hydrogen compressor;

(h) passing the compressed hydrogen from the recycle gas compressor to the primary reactor loop; and (i) passing at least a portion of the unconverted oil from the fractionator of steps (c) and (f) to facilities for the preparation of Group III oil, white oil, or BMCI ethylene feed.

The instant invention provides reduced capital investment and operating costs, as compared with the traditional two stage hydroprocessing scheme.

BRIEF DESCRIPTION OF THE FIGURE

The FIGURE illustrates a two-stage hydroprocessing unit adapted for use in the instant invention. Hydrotreating preferably occurs in the first stage, while hydrocracking preferably occurs in the second stage.

DETAILED DESCRIPTION OF THE INVENTION

Description of the Preferred Embodiment

Figure 1:
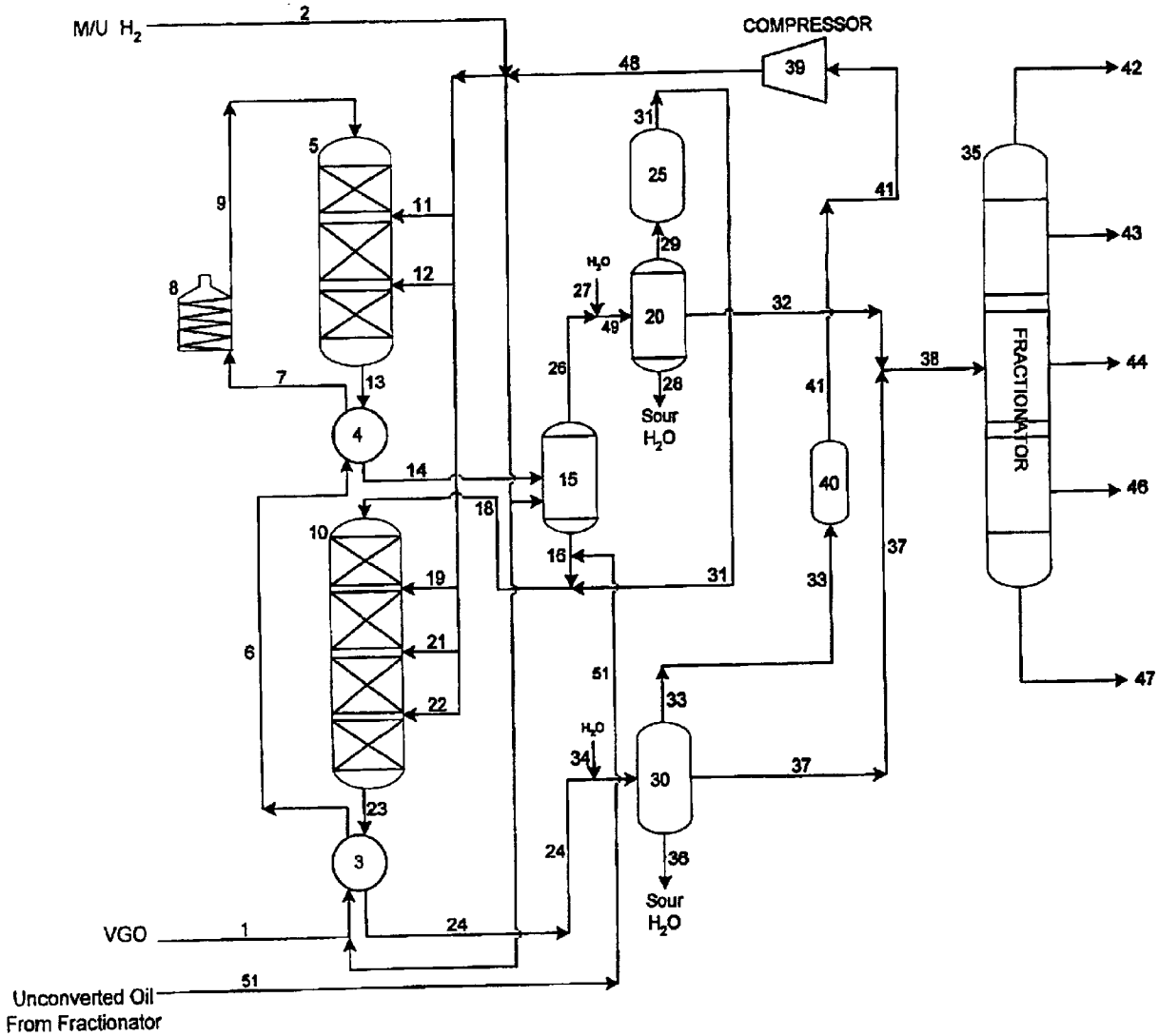

A hydrocarbon feed (stream 1) preferably comprising gas oil in combination with nitrogen (although other hydrocarbon feeds containing nitrogen may be employed) is combined with hydrogen (stream 2) and heated in heat exchanger 3. The feed is then passed, through stream 6, to exchanger 4. Stream 7 exits the heat exchanger and passes to furnace 8 for further heating.

Stream 9 exits the furnace and enters the first-stage hydroprocessor, in which the stream is contacted with hydrotreating catalyst in one or more beds. Hydrogen may be employed as an interbed quench, as illustrated by streams 11 and 12. In the first-stage hydroprocessor, the oil feed is hydrotreated and partially converted into products. Stream 13, the hydroprocessor effluent, comprises light vaporized hydrocarbons, distillate oils, heavy unconverted oil, and excess hydrogen not consumed in the reaction.

Stream 13 is slightly cooled in heat exchanger 4, by heat exchange with stream 6, the feed to the first stage hydroprocessor. The cooled stream, now stream 14, passes to high pressure stripper 15. A part of the make-up hydrogen (stream 2) is used as the stripping media.

Vapor from the high pressure stripper 15 (stream 26) is first cooled by process streams (not shown) and then by an air cooler (not shown) before passing to the cold high pressure separator 20. Wash water (stream 27) is continually injected upstream of the air cooler to prevent the deposition of salts in the air cooler tubes.

In the cold high pressure separator 20, the cooled first stage effluent, line 49 is separated into its hydrogen-rich vapor (stream 29), hydrocarbon liquid (stream 32), and water phases (stream 28) in the cold high pressure separator 20. The sour water stream 28, which contains ammonium bisulfide, is sent to sour water stripping. The hydrocarbon liquid effluent of the cold high pressure separator 20, line 32, is combined with the hydrocarbon liquid from the cold high pressure separator 30 (stream 37) to create line 38, which enters fractionator 35. The hydrocarbon stream is heated and distilled into product streams illustrated, gas 42, naphtha 43, kerosene 44, diesel 46 and bottoms 47.

The second stage reactor 10 converts the unconverted oil from the first stage into products. Hydrogen enters as interbed quench through streams 19, 21 and 22. The second-stage reactor effluent, stream 23, consists of light vaporized hydrocarbons, distillate oils, heavy unconverted oil, and excess hydrogen not consumed in the reaction. This effluent stream is cooled by heat exchange (exchanger 3) with the process streams (stream 1) and finally with an air cooler (not shown) before it passes, in stream 24, to the cold high pressure separator 30. The hydrogen rich gas (stream 33) flows into knockout drum 40. Stream 41 exits the knockout drum 40 as stream 41 and passes to the recycle gas compressor 39. Recycle compressor 39 delivers the recycle gas to the reactor loop in stream 48. Part of the recycle compressor discharge gas is routed to the first-stage reactor as quench (streams 11 and 12) to control the reactor temperature. The remaining recycle gas that is not used as quench in either the first or second stage (streams 19, 21 and 22 for the second stage) is combined with the make-up hydrogen (stream 2) to become the first-stage reactor feed gas. The first-stage reactor feed gas is heated by process streams before combining with the first-stage oil feed.

Feeds

A wide variety of hydrocarbon feeds may be used in the instant invention. Typical feedstocks include any heavy or synthetic oil fraction or process stream having a boiling point above 392° F. (200° C.). Such feedstocks include vacuum gas oils, heavy atmospheric gas oil, delayed coker gas oil, visbreaker gas oil demetallized oils, vacuum residua, atmospheric residua, deasphalted oil, Fischer-Tropsch streams, and FCC streams. An upgraded base stock useful as a feedstock to the hydrotreater process preferably contains less than about 200 ppm sulfur and about 100 ppm nitrogen, and has a viscosity index of greater than about 80, with a viscosity index of greater than 85 and even greater than 90 being preferred.

Lubricating oil base stocks that are suitable for use in the present invention also may be recovered from a solvent extraction process. In solvent extraction, a distillate fraction, generally a vacuum gas oil, which optionally has been desulfurized, is contacted with a solvent, such as N-methyl pyrrolidone or furfural, in a solvent extraction zone, preferably employing a countercurrent extraction unit. The aromatics-lean raffinate is stripped of solvent, optionally dewaxed, and subsequently hydrogenated to improve product stability and color. The recovered solvent is usually recycled.

Products

Group III base stocks, with greater than or equal to 90% saturates, less than or equal to 0.03 percent sulfur, and with a viscosity index greater than or equal to 120, may be produced from this invention. Test methods for evaluating group category properties including: saturates—ASTM D-2007; viscosity index—ASTM D2270; sulfur—one of ASTM D-2622, ASTM D-4294, ASTM D-4927, ASTM D-3120. The viscosity of the finished lube oil, when measured at 100° C. (212° F.), is generally greater than 2 cSt.

A white oil base stock may also be prepared from this invention. A white oil is defined herein as a mineral oil which may be safely used in food/food packaging. It is a mixture of liquid hydrocarbons, essentially paraffinic and naphthenic in nature obtained from petroleum. It is refined to meet the test requirements of the United States Pharmacopeia (U.S.P.) XX (1980), at page 532, for readily carbonizable substances. It also meets the test requirements of U.S.P. XVII for sulfur compounds at page 400.

A white oil produced in the present process meets the requirements of regulation 21 CFR 172.878, 21 CFR 178.3620(a), 21 CFR 178.3620(b), or 21 CFR 178.3620(c), all refer to Apr. 1, 1996 edition, for USP and technical grade white oils, which regulations of its Apr. 1, 1996 edition are incorporated herein by reference.

Emphasis is placed on the lube base stock feeds that may be produced from this invention, but the process of this invention is also useful in the production of middle distillate fractions boiling in the range of about 250–700° F. (121–371° C.). A middle distillate fraction is defined as having an approximate boiling range from about 250° F. to 700° F. At least 75 vol %, preferably 85 vol %, of the components of the middle distillate has a normal boiling point of greater than 250° F. At least about 75 vol %, preferably 85 vol %, of the components of the middle distillate has a normal boiling point of less than 700° F. The term "middle distillate" includes the diesel, jet fuel and kerosene boiling range fractions. The kerosene or jet fuel boiling point range refers to the range between 280° F. and 525° F. (38–274° C.). The term "diesel boiling range" refers to hydrocarbons boiling in the range from 250° F. to 700° F. (121–371° C.).

Gasoline and naphtha may also be produced in this invention. Gasoline or naphtha normally boils in the range below 400° F. (204° C.), or $C_{10}$—. Boiling ranges of various product fractions recovered in any particular refinery will vary with such factors as the characteristics of the crude oil source, local refinery markets, and product prices.

Conditions

The first stage of the instant invention is directed to hydrotreating of lubricating oil base stocks. The hydrogenation reaction takes place in the presence of hydrogen, preferably at hydrogen pressures in the range of between about 500 psig and 5000 psig, more preferably in the range of about 1200 psig to about 2500 psig. The feed rate to the hydrogenation catalyst system is in the range of from about 0.1 to about 5 LHSV, preferably in the range of about 0.2 to about 1.5 LHSV. The hydrogen supply (make-up and recycle) is in the range of from about 500 to about 20,000 standard cubic feet (SCF) per barrel of liquid hydrocarbon feed, preferably in the range of from about 2000 to about 10,000 standard cubic feet per barrel.

Hydroprocessing conditions are a general term which refers primarily in this application to hydrocracking or hydrotreating, preferably hydrocracking. The first stage reactor, as depicted in FIG. 1, is a hydrotreating zone.

Typical hydrocracking conditions include a reaction temperature of from 400° F.–950° F. (204° C.–510° C.), preferably 650° F.–850° F. (343° C.–454° C.). Reaction pressure ranges from 500 to 5000 psig (3.5–4.5 MPa), preferably 1500–3500 psig, and more preferably in the range from 1500 to 2500 psig. LHSV ranges from 0.1 to 15 $hr^{-1}$ (v/v), preferably 0.25–2.5 $hr^{-1}$. Hydrogen consumption ranges from 500 to 2500 SCF per barrel of liquid hydrocarbon feed (89.1–445 $m^3$ $H_2/m^3$ feed).

Catalyst

Each hydroprocessing zone may contain only one catalyst, or several catalysts in combination.

Hydrotreating catalyst usually is designed to remove sulfur and nitrogen and provide a degree of aromatic saturation. It will typically be a composite of a Group VI metal or compound thereof, and a Group VIII metal or compound thereof supported on a porous refractory base such as alumina. Examples of hydrotreating catalysts are alumina supported cobalt-molybdenum, nickel sulfide, nickel-tungsten, cobalt-tungsten and nickel-molybdenum. Typically, such hydrotreating catalysts are presulfided.

The hydrocracking catalyst generally comprises a cracking component, a hydrogenation component, and a binder. Such catalysts are well known in the art. The cracking component may include an amorphous silica/alumina phase and/or a zeolite, such as a Y-type or USY zeolite. Catalysts having high cracking activity often employ REX, REY and USY zeolites. The binder is generally silica or alumina. The hydrogenation component will be a Group VI, Group VII, or Group VIII metal or oxides or sulfides thereof, preferably one or more of iron, chromium, molybdenum, tungsten, cobalt, or nickel, or the sulfides or oxides thereof. If present in the catalyst, these hydrogenation components generally make up from about 5% to about 40% by weight of the catalyst. Alternatively, noble metals, especially platinum and/or palladium, may be present as the hydrogenation component, either alone or in combination with the base metal hydrogenation components iron, chromium molybdenum, tungsten, cobalt, or nickel. If present, the platinum group metals will generally make up from about 0.1% to about 2% by weight of the catalyst.

Catalyst selection is dictated by process needs and product specifications.

What is claimed is:

1. A method for hydroprocessing a hydrocarbon feedstock which produces a stream of unconverted oil of sufficient quality for use as a base oil feed for the production of Group III oils, white oils and low BMCI ethylene plant feed, said method employing multiple reaction zones within a single reaction loop, comprising the following steps:

(a) passing a hydrocarbonaceous feedstock to a first hydroprocessing zone, the hydroprocessing zone having one or more beds containing hydroprocessing catalyst, the hydroprocessing zone being maintained at hydroprocessing conditions, including a pressure in the range from 500 to 5000 psig, wherein the feedstock is contacted with catalyst and hydrogen;

(b) passing the effluent of step (a) directly to a hot high pressure stripper, wherein the effluent is contacted with a hydrogen-rich stripping gas to produce a vapor stream comprising hydrogen, hydrocarbonaceous compounds boiling at a temperature below the boiling range of the hydrocarbonaceous feedstock, hydrogen sulfide, ammonia, and a bottoms stream comprising hydrocarbonaceous compounds boiling in approximately the same range of said hydrocarbonaceous feedstock along with a portion of the hydrocarbonaceous compounds boiling in the diesel boiling range;

(c) passing the overhead vapor stream from the hydrogen stripper of step (b) to a first cold high pressure separator where hydrogen, hydrogen sulfide and light hydrocarbonaceous gases are removed overhead and a liquid stream comprising naphtha, middle distillates and unconverted oil is passed to fractionation, thereby removing most of the ammonia and some of the hydrogen sulfide (as ammonium bi-sulfide in the sour water stream as it leaves the cold high-pressure separator);

(d) combining the liquid stream from the hydrogen stripper of step (b) with a portion of the unconverted oil of the fractionation step of step (c) and passing the combined stream to a bed of hydroprocessing catalyst in a second reactor zone, wherein the liquid is contacted under hydroprocessing conditions with the catalyst, in the presence of hydrogen, and under a pressure in the range from 500 to 5000 psig;

(e) passing the overhead from the cold high pressure separator of step (c) to an amine absorber, where hydrogen sulfide is removed before hydrogen is compressed and recycled to hydroprocessing vessels within the loop;

(f) passing the effluent of step (d), after cooling, to a second cold high pressure separator where hydrogen, hydrogen sulfide and light hydrocarbonaceous gases are removed overhead and a liquid stream comprising naphtha, middle distillates and unconverted oil is passed to fractionation, thereby removing most of the ammonia and some of the hydrogen sulfide (as ammonium bi-sulfide in the sour water stream as it leaves the second cold high-pressure separator);

(g) passing the vapor stream from step (f) after further cooling and separation of condensate, to the recycle gas hydrogen compressor;

(h) passing the compressed hydrogen from the recycle gas hydrogen compressor to the primary reactor loop; and (i) passing at least a portion of the unconverted oil from the fractionator of steps (c) and (f) to facilities for the preparation of Group III oil, white oil, or BMCI ethylene feed.

2. The process of claim 1, in which hydrotreating occurs in the first hydroprocessing zone and hydrocracking occurs in the second hydroprocessing zone.

3. The process of claim 1, wherein the hydroprocessing conditions of claim 1, step (a), comprise a reaction temperature of from 400° F.–950° F. (204° C.–510° C.), a reaction pressure in the range from 1200 to 2500 psig, an LHSV in the range from 0.1 to 15 $hr^{-1}$ (v/v), and hydrogen consumption in the range from 500 to 2500 scf per barrel of liquid hydrocarbon feed (89.1–445 $m^3$ $H_2/m^3$ feed).

4. The process of claim 3, wherein the hydroprocessing conditions of claim 1, step (a), preferably comprise a temperature in the range from 650° F.–850° F. (343° C.–454° C.), reaction pressure in the range from 1200 to 2500 psig an LHSV in the range from 0.25 to 2.5 $hr^{-1}$, and hydrogen consumption in the range from 500 to 2500 scf per barrel of liquid hydrocarbon feed (89.1–445 $m^3$ $H_2/m^3$ feed).

5. The process of claim 1, wherein the hydroprocessing conditions of claim 1, step (d), comprise a reaction temperature of from 400° F.–950° F. (204° C.–510° C.), a reaction pressure in the range from 500 to 5000 psig), an LHSV in the range from 0.1 to 15 $hr^{-1}$ (v/v), and hydrogen consumption in the range from 500 to 2500 scf per barrel of liquid hydrocarbon feed (89.1–445 $m^3$ $H_2/m^3$ feed).

6. The process of claim 5, wherein the hydroprocessing conditions of claim 1, step (d), preferably comprise a temperature in the range from 650° F.–850° F. (343° C.–454° C.), reaction pressure in the range from 1500 to 2500 psig, LHSV in the range from 0.25 to 2.5 $hr^{-1}$, and hydrogen consumption in the range from 500 to 2500 scf per barrel of liquid hydrocarbon feed (89.1–445 $m^3$ $H_2/m^3$ feed).

7. The process of claim 1, wherein the feed to claim 1, step (a), comprises hydrocarbons boiling above 392° F. (200° C.).

8. The process of claim 7, wherein the feed is selected from the group consisting of vacuum gas oil, heavy atmospheric gas oil, delayed coker gas oil, visbreaker gas oil, demetallized oils, FCC light cycle oil, vacuum residua deasphalted oil, Fischer-Tropsch streams, and FCC streams.

9. The process of claim 1, wherein the second hydroprocessing zone of step (d) is maintained at a lower pressure than that of the first hydroprocessing zone of step (a).

10. The process of claim 1, in which each hydroprocessing zone may contain only one catalyst, or several catalysts in combination.

* * * * *